United States Patent [19]

Smith et al.

[11] 3,949,703

[45] Apr. 13, 1976

[54] SELF-CLEANING DEVELOPER APPLICATOR

[75] Inventors: Ian Edward Smith, Lockleys; Dennis I. Scroggs, Para Hills; Peter J. Hastwell, Elizabeth Grove, all of Australia

[73] Assignee: Savin Business Machines Corporation, Valhalla, N.Y.

[22] Filed: Dec. 30, 1971

[21] Appl. No.: 213,885

[52] U.S. Cl. ..... 118/637; 118/DIG. 23; 427/17

[51] Int. Cl.[2] ..... G03G 15/10

[58] Field of Search..... 118/623, 637, DIG. 23; 117/37 LE, 93.4 A; 427/15, 17

[56] References Cited

UNITED STATES PATENTS

| | | | |
|---|---|---|---|
| 3,256,855 | 6/1966 | Oliphant | 118/637 |
| 3,332,396 | 7/1967 | Gundlach | 118/637 |
| 3,376,852 | 4/1968 | Weiler | 118/637 |
| 3,437,074 | 4/1969 | Hagopian et al. | 118/623 |
| 3,510,903 | 5/1970 | Stoever et al. | 15/256.5 |
| 3,556,050 | 1/1971 | Trachtenberg et al. | 118/637 |
| 3,592,166 | 7/1971 | Wu | 118/637 |
| 3,669,073 | 6/1972 | Savit et al. | 118/637 |
| 3,672,329 | 6/1972 | Yamanoi | 118/637 |
| 3,687,708 | 8/1972 | Miller | 117/37 LE |
| 3,707,139 | 12/1972 | Fukushima et al. | 118/637 |

FOREIGN PATENTS OR APPLICATIONS

| | | | |
|---|---|---|---|
| 886,526 | 11/1971 | Canada | 117/37 LE |

*Primary Examiner*—Mervin Stein
*Assistant Examiner*—Douglas Salser
*Attorney, Agent, or Firm*—Shenier & O'Connor

[57] ABSTRACT

A self-cleaning developer applicator system for applying liquid developer to a latent electrostatic image carried by an organic photoconductor supported on a conductive substrate which moves relative to a developer station in which a biasing potential is applied between the substrate and a conductive developer applicator electrode to reduce the effect of the background potential of the latent image while adequately developing desired image areas together with means for cleaning the applicator electrode continuously during operation of the system to remove toner particles which collect thereon under the influence of the biasing potential. In a preferred embodiment the applicator is arranged to flow a film of developer liquid at the speed of movement of the photoconductive surface over a relatively extended area of the image during development thereof.

14 Claims, 6 Drawing Figures

INVENTORS
Ian E. Smith
Dennis I. Scroggs
Peter J. Hastwell
BY
Shenier & O'Connor
ATTORNEYS INVENTOR.
Ian E. Smith
Dennis I. Scroggs
Peter J. Hastwell
BY
Shenier & O'Connor
ATTORNEYS Fig 3
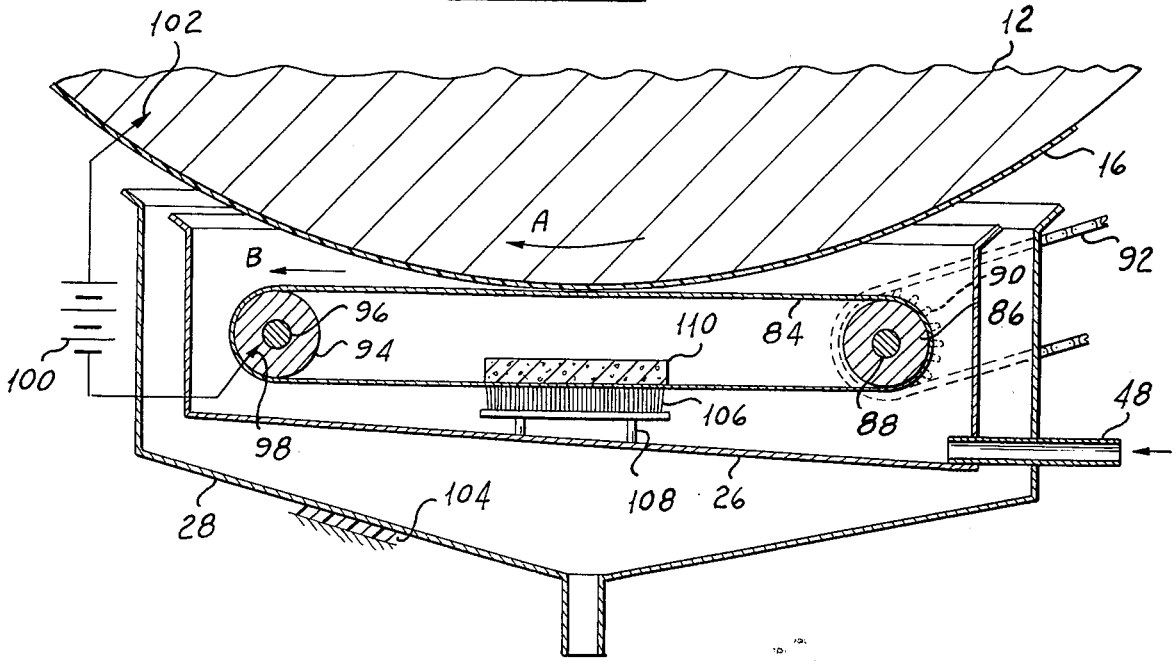
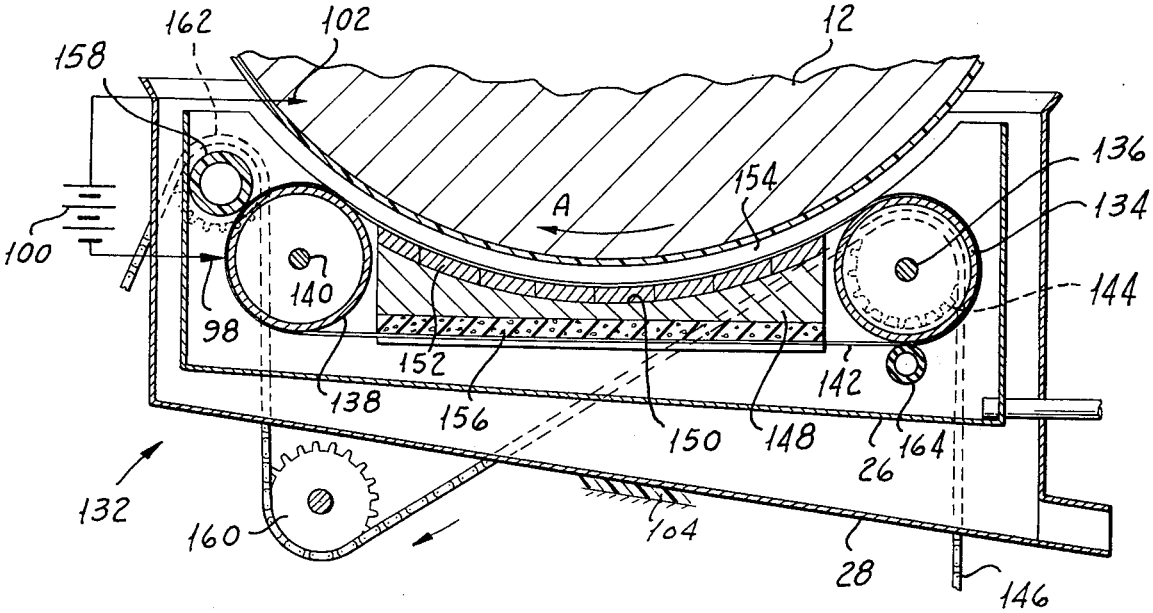
Fig 6
INVENTORS
Ian E. Smith
Dennis I. Scroggs
Peter J. Hastwell
BY Shenier & O'Connor
ATTORNEYS

SELF-CLEANING DEVELOPER APPLICATOR

BACKGROUND OF THE INVENTION

Electrostatic copying systems are known in the prior art in which a photoconductive surface first is charged and then is exposed to a light image of the original to be copied to produce a latent electrostatic image on the photoconductor. This image is subjected to a developer made up of electrostatic toner particles in a carrier. In the course of development, the toner particles are attracted to the charged areas to develop the latent image.

There are known in the prior art organic photoconductive materials which combine the advantages of transparency, flexibility, ease of coating and panchromatic response with low cost. Kaale & Company of Germany has developed a large number of organic photoconductors such as the oxazoles described in Uhlig German Pat. No. 1,117,391 of Nov. 16, 1961. Many other organic photoconductors are known such as benzanthrones, triazines, acylhydrazones and the like.

While organic photoconductors of the type mentioned above combine many advantages, their use heretofore has been limited owing to the fact that their discharge times are inordinately long. That is to say, in use of such materials in electrostatic copying, they may be initially charged to, for example, 800 volts. Tests have shown that an initial discharge from about 800 volts to about 100 volts requires about 3 footcandle-seconds. However, to discharge the photoconductor to about 10 volts requires 36 footcandle-seconds. Complete discharge of the photoconductor requires an inordinately great exposure of the material. To achieve such a discharge, the exposure time would have to be so long, or the optical system so large, or both, as to make a system of electrostatic copying employing an organic photoconductor entirely impracticable. That is to say, if, using an organic photoconductor, an electrostatic copying machine were run at conventional speeds with a conventional exposure system, development would result in a copy in which desired image areas could scarcely be distinguished from background areas.

Recognizing the problem of employing organic photoconductors in an electrostatic copying system, we conceived of the application of an electrical field to counteract the effect of background potential in the organic photoconductor while at the same time adequately developing desired image areas. In setting up such a counter field, we apply a bias potential between a conductive substrate carrying the organic photoconductor and a conductive developer applicator electrode.

While application of the counter field in the manner described above initially successfully overcame background potential in the photoconductor, it resulted in collection of toner particles on the electrode with the result that the system ultimately became ineffective and the quality of copies produced rapidly deteriorated. We provide our system with means for continuously cleaning the biasing electrode to remove toner particles which otherwise would collect thereon under the influence of the biasing potential.

In the course of our investigation we further noted the presence of "tails" at the trailing edge of each toner image deposit. We discovered that this phenomenon, which can be termed "toner-tank tailing," can be substantially eliminated by producing over the image area being developed a flow of developer at the surface speed of the photoconductor relative to the developer station.

SUMMARY OF THE INVENTION

One object of our invention is to provide a self-cleaning developer applicator for use with an organic photoconductor imaging surface.

Another object of our invention is to provide a self-cleaning developer applicator which substantially eliminates the effect of background potential in an image-carrying organic photoconductor.

A further object of our invention is to provide a self-cleaning developer applicator which inhibits the buildup of toner particles on the applicator biasing electrode.

Still another object of our invention is to provide a self-cleaning developer applicator for use with an organic photoconductor which produces clear copies over a relatively long period of time in use.

A still further object of our invention is to provide a self-cleaning developer applicator which substantially eliminates "toner-tank tailing" in copies produced in a system incorporating the applicator.

Other and further objects of our invention will appear from the following description.

In general, our invention contemplates the provision of a self-cleaning developer applicator for use with an organic photoconductor in which a bias potential is applied between a conductive substrate carrying the photoconductor and a developer applicator electrode as the image bearing photoconductor moves relative to the developer station to overcome the effect of background potential in the image together with means for continuously cleaning the biasing electrode to remove toner particles which collect thereon under the influence of the biasing potential. We prefer to flow a film of developer over an area of the image under development at the same speed as that of the image-bearing surface relative to the developer station during the course of development.

BRIEF DESCRIPTION OF THE DRAWINGS

In the accompanying drawings which form part of the instant specification and which are to be read in conjunction therewith and in which like reference numerals are used to indicate like parts in the various views:

FIG. 3 is a sectional view of one form of our self-cleaning developer applicator.

FIG. 6 is a sectional view of yet another form of our self-cleaning developer applicator.

DESCRIPTION OF THE PREFERRED EMBODIMENT

Figure 1:
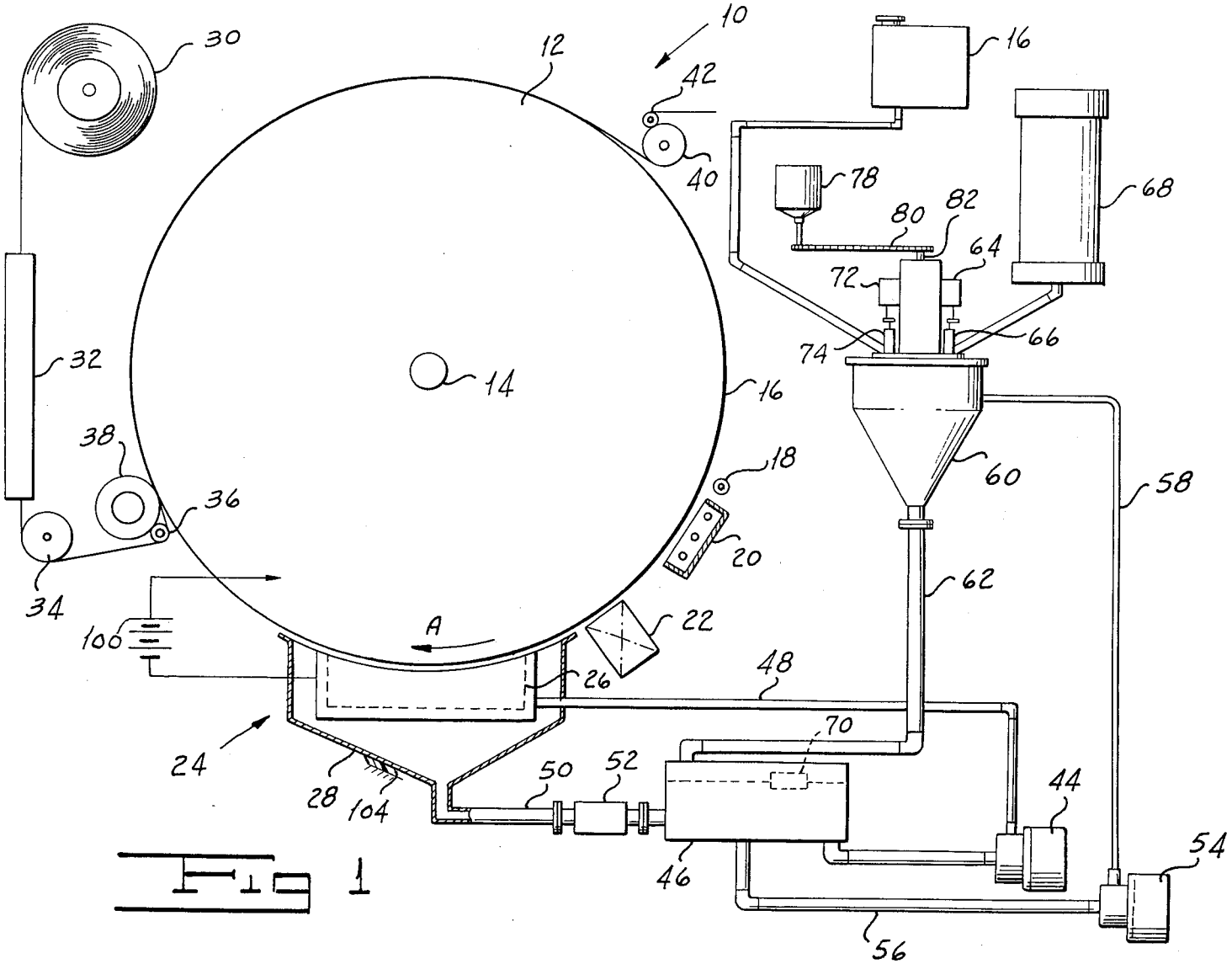
FIG. 1 is a schematic view of one form of electrostatic copying system incorporating our self-cleaning developer applicator.

Referring now to FIG. 1, one type of electrostatic copying machine, indicated generally by the reference character 10, which may incorporate our self-cleaning developer applicator, includes a drum 12 carried by a shaft 14 for rotary movement in the direction of the arrow A. Drum 12 carries a film 16 of a suitable photoconductive material which may, for example, be one of the organic photoconductors described hereinabove.

In operation of the machine 10, as the drum 12 rotates surface 16 moves past an exhaust exposure source 18 of light which is adapted to remove any charge remaining on the drum as a result of a previous operation. Drum 12 moves surface 16 past a corona discharge system 20 which, as is known in the art, is adapted to apply a predetermined electrostatic charge to the photoconductive film 16. After receiving the charge the film passes an exposure system 22 which exposes the film to the image of the original to be copied so that surface charge is lost in non-image areas while being retained in areas to be developed.

After leaving the exposure system 22 the surface 16 carrying the latent electrostatic image moves through the developer system indicated generally by the reference character 24 which applies a developer to the surface of film 16 to develop the image. The system 10 may, for example, be of the type disclosed in the copending application of Smith et al (I) Ser. No. 155,108 filed June 21, 1971, now U.S. Pat. No. 3,839,032, in which the developer applied by the system 24 is made up of a tacky toner in a suitable carrier. Paper or other material from a roll 30 moves through a heating unit 32 around a guide roll 34 and is pressed into contact with the surface of the film 16 by means of a pressure roll 38. As the tacky toner image leaves the developer station, it is pressed into contact with the paper in engagement with the surface of film 16. Owing to the fact that the tacky toner has greater affinity for the surface of the paper than for the photoconductive film, the image is transferred to the paper. Following transfer of the image to the paper, it moves around guide rolls 40 and 42 which deliver the copy. As is more fully pointed out in the Smith et al. (I) application, a cutter may be employed to cut the copy to length.

We employ apparatus of the type disclosed in the copending application of Smith et al. (II) for "Apparatus for Developing Electrostatic Images " Ser. No. 212,155 filed Dec. 27, 1971, now U.S. Pat. No. 3,789,794 for supplying an emulsion of tacky toner particles in a carrier to the developer tank 26 of the developer applicator apparatus 24. A pump 44 delivers developer liquid from a supply tank 46 through a pipe 48 to the tray 26. Overflow from the tray 26 is collected in a trough 28 from which the liquid travels back through a line 50 to the tank 46. A developer liquid concentration monitoring unit 52 of any suitable type known to the art monitors the concentration of toner in carrier liquid. A second pump 54 circulates developer liquid from tank 46 through a line 56 through the pump 54 to a line 58 through an emulsifier 60 and to a line 62 leading back to the tank 46.

As is more fully pointed out in the Smith et al. (II) application, when the concentration of toner in the developer liquid falls below an acceptable level monitor 52 puts out a signal which energizes a solenoid 64 to open a valve 66 to admit toner concentrate from a tank 68 into the emulsifier 60. A liquid level switch 70 senses the level of developer liquid in tank 46. When the liquid falls below a predetermined level, switch 70 completes the circuit of a solenoid 72 to open a valve 74 to admit carrier liquid from a tank 76 into the mill 60. A motor 78 drives a pitch chain 80 to drive the input shaft 82 of the emulsifier 60. Since the construction and operation of the liquid supply system does not per se form part of our invention, we will not describe it in greater detail. The details of this system are more fully shown and described in the Smith et al. (II) application.

Figure 2:
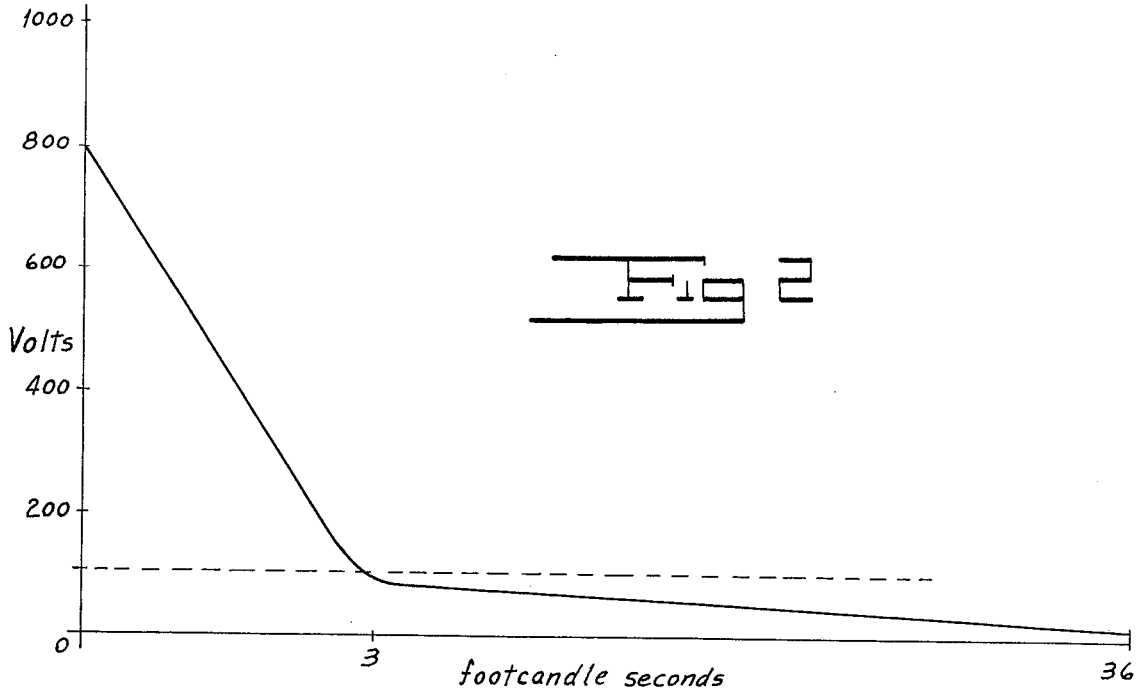
FIG. 2 is a diagrammatic view illustrating the discharge characteristic of a typical organic photoconductor.

As has been pointed out hereinabove, the machine 10 with which our developer applicator is used employs an organic photoconductor 16 on which the latent image is formed. Referring now to FIG. 2, we have shown an idealized discharge curve of a typical organic photoconductor. In the FIGURE, the initial voltage or voltage to which the film is charged is the ordinate while the logarithm of the light exposure in footcandle-seconds is the abscissa. As can be seen from the FIGURE, with the film initially charged to about 800 volts, 3 footcandle-seconds of exposure is required to discharge the film to about 100 volts. To discharge the film further to about 10 volts requires 36 footcandle-seconds of exposure. It can further be seen from the characteristic curve that an extremely great exposure is required fully to discharge the film. As is also pointed out hereinabove, such an exposure would require a very large optical system and would require an inordinately long period of time. We apply such a bias between the conductive substrate of the drum 12 and an electrode for applying the developer in a manner to be described as effectively to raise the abscissa of the plot of FIG. 2 thus to counteract the effect of the residual charge after a predetermined exposure. By way of example, we may apply a bias of 100 volts to raise the abscissa to the level indicated by the broken line in FIG. 2 thus to require an exposure of only 3 footcandle-seconds and yet be able effectively to develop desired image areas.

Referring now to FIG. 3, the developer applicator system 24 includes a belt 84 of any suitable material which enables it to function as an electrode to which the biasing potential can be applied. The belt may be made of a fabric having a metallized outer surface to which the biasing potential is applied in any suitable manner or the belt may be formed entirely of conductive material. We support belt 84 on a driven roll 86 carried by a shaft 88 rotatably supported in tray 26 in any suitable manner known to the art. Shaft 88 extends outwardly through the wall of tray 26 and through the wall of trough 28 to a location at which a sprocket wheel 90 thereon can receive a pitch chain 92. Chain 92 may be the main driving chain of the apparatus which also drives the drum 12 in operation of the machine. Preferably, we so construct the apparatus that chain 92 drives the belt 84 in the direction of the arrow B in FIG. 3 and at the same linear speed as the surface speed of drum 12. An idler roller 94 carried by a shaft 96 rotatably supported in tray 26 also supports belt 84. We so arrange the parts in this form of our developer system as to form a narrow gap of from about 0.005 to 0.030 inch between the film 16 and the surface of belt 84 at their closest point of approach. Thus, as will be described hereinbelow, as the belt is driven it carries developer into that gap to cause the developer to contact the surface of the drum, but no physical contact is made between the belt and the surface of film 16.

As has been pointed out hereinabove, we apply such a bias to the developer applicator electrode belt 84 as to counteract the effect of the residual potential in exposed background areas of film 16 after exposure thereof. This may be accomplished in any convenient manner. For example, where both the belt 84 and the roller 94 are conductive, a brush 98 connects the negative terminal of a suitable source of potential such as a battery 100 to the roller 94. A brush 102 connects the positive battery terminal to the conductive substrate of drum 12. It will readily be appreciated that we may either make the drum 12 itself of conductive material or we may provide the drum with a conductive film underlying the film 16 of organic photoconductive material. Where the photoconductive material has a characteristic such as that illustrated in FIG. 2 we may select battery 100 to have a potential of, for example, 100 volts. In this form of our invention, we also insulate trough 28 from ground as indicated by insulation 104 to inhibit collection of toner particles thereon.

As has further been pointed out hereinabove, application of the biasing potential to the belt 84 causes particles of toner in the developer within the tray 26 to collect on the surface of the belt. We mount a brush 106 on a bracket 108 in the bottom of tray 26. Brush 106 engages the outer surface of the belt 84. The brush 106 may be made of any suitable material such, for example, as a nylon pile fabric or the like. A backing member 110 in engagement with the inner surface of the belt 84 ensures good contact of the brush 106 with the outer surface of the belt 84. If the belt proper is formed of an insulating material, the outer surface of which is metallized, brush 98 is arranged to make electrical contact with the metallized surface. In such case, particles of toner tend to collect on the outer surface of the belt so that the brush 106 effectively removes these particles from the belt. If the entire belt is conductive, we may form backing member 110 from a suitable material such as sponge rubber or the like to remove any toner particles which might tend to collect on the inner surface of the belt.

Alternatively to the arrangement described above in which the biasing potential is applied to the applicator belt 84, we might apply the biasing potential to the tray 26 and employ an insulated belt. In such case, however, toner particles would tend to collect on the surface of the tank. Such an arrangement would create the obvious difficulty of cleaning particles from the tray surface. As a further alternative, the belt 84 might be biased with the tray 26 at ground. Such an arrangement, however, would result in deposition of toner particles both on the belt and on the tank, thus compounding the difficulty of cleaning surfaces on which toner particles are deposited. Owing to these facts, we prefer to apply the biasing potential to the applicator element and to insulate the developer system from ground.

Figure 4:
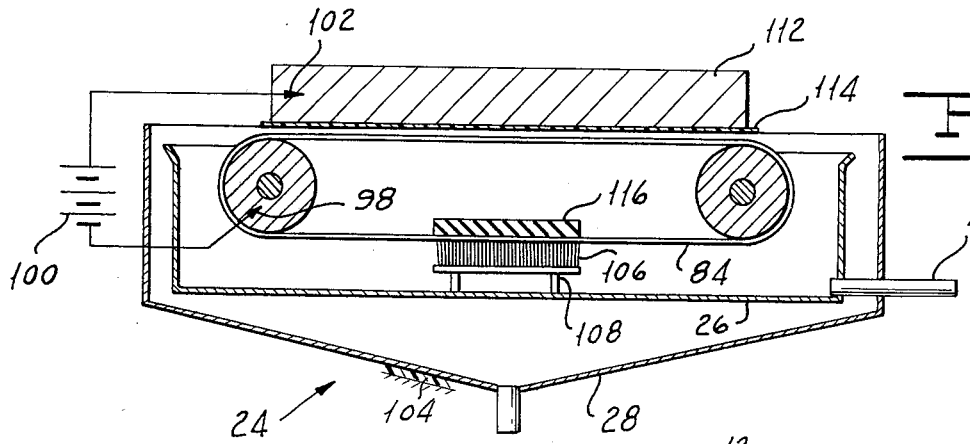
FIG. 4 is a sectional view of an alternate form of our self-cleaning developer applicator.

Referring now to FIG. 4, we have shown an arrangement similar to that described in FIG. 3 in which our developer apparatus 24 is applied to a linear rather than to a rotary machine. In such a linear machine a carriage 112 supports a film of organic photoconductive material 114 for movement along a line past the developer unit 24. The parts of the system 24 are substantially the same as those described in connection with FIG. 3. In FIG. 4, however, brush 102 engages the conductive carriage 112 instead of the conductive substrate of the drum 12 as in FIG. 3.

Figure 5:
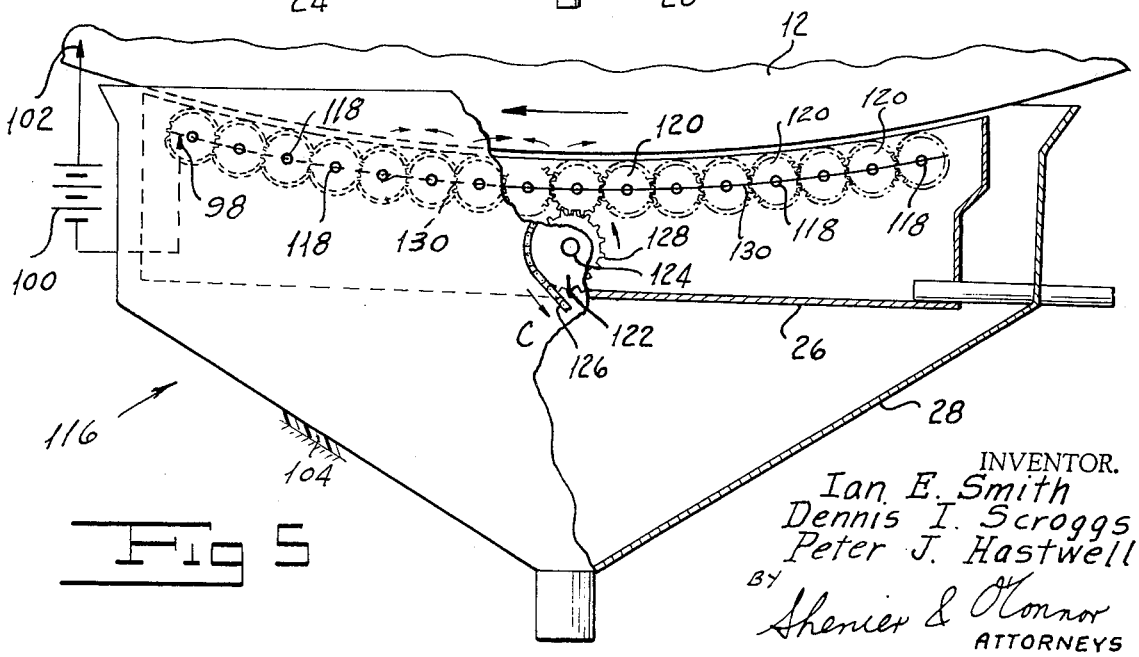
FIG. 5 is an elevation with parts broken away and with other parts shown in section of a further form of our self-cleaning developer applicator.

Referring now to FIG. 5, we have shown yet another form of developer system, indicated generally by the reference character 116, which includes a tray 26 and a return trough 28 similar to those described hereinabove in connection with the showings of FIGS. 3 and 4. In this form of our invention, a plurality of shafts 118 are rotatably supported in the walls of tray 26 for rotary movement around axes disposed on the locus of an arc parallel to the surface of the film 16. Each shaft 118 carries for rotation therewith a gear roller 120 extending axially of the drum 12 for a distance at least equal to the axial extent of the film 16. The teeth of adjacent gear rollers 120 mesh. Their peripheries are slightly spaced from the surface of the film 16. A sprocket wheel 122, supported on a shaft 124 carried by the tray 26 is driven by a pitch chain 126 in the direction of the arrow C. Pitch chain 126 may, for example, be the main driving chain of the apparatus. A pinion 128 within the tray 26 engages and drives one of the gear rollers 120 which, in turn drives the remaining gear rollers of the system. As a result, as indicated by the arrows over the rollers in FIG. 5, adjacent rollers rotate in opposite directions. Owing to this rotation, developer liquid is carried upwardly into contact with the surface of the film 16 over a relatively extended area thereof. moreover, as the gear rollers rotate, interengagement of the teeth thereof over the length of the rollers produces a self-cleaning action which removes toner particles which otherwise would collect thereon. In this form of our invention, brush 102 engages the conductive substrate of drum 12. Brush 98 engages a conductive arc 130 which is in electrical contact with all of the shafts 118. In this way, we apply the biasing potential of battery 100 to all of the gear rollers 120.

Referring now to FIG. 6, still another form of our developer system, indicated generally by the reference character 132, includes the tray 26 and a collecting trough 28. A driven roller 134 of any suitable material such, for example, as an aluminum alloy is carried by a shaft 136 rotatably supported in the walls of tray 26. An idler roller 138 is supported on a shaft 140 rotatably supported in the walls of tray 26. Rollers 134 and 136 carry a thin belt 142 of conductive magnetic material such, for example, as a 0.002 inch thick steel shim material. Shaft 136 extends outwardly of tray 26 and trough 28 to receive a sprocket wheel 144 driven by a pitch chain 146. Pitch chain 146 may be the main driving chain of the apparatus. As will more fully be explained hereinafter, we so arrange the apparatus that the belt 142 is driven at the same speed as the surface speed of the film 16.

A support 148, located within the tray 26, is formed with an arcuate concave surface 150 which receives a plurality of magnets 152 on the locus of an arc generally parallel to the surface of film 16. Magnets 152 attract belt 142 to cause a portion thereof adjacent to the surface of film 16 to assume an arcuate configuration with a narrow space or flow gap 154 between the belt and the film 16. Gap 154 may have a radial dimension of from about 0.005 to about 0.030 inch. When the belt 142 is driven, developer material is carried along the gap 154 at substantially the same velocity as the speed of movement of the surface of the film 16. Owing to that fact, the "tails" of toner material which otherwise might extend from the trailing edges of developed image areas are substantially eliminated.

In the form of our developer system illustrated in FIG. 6, brush 102 engages the conductive substrate of drum 12. Brush 98 contacts the surface of the steel belt 142 to apply the biasing potential thereto. As the belt rotates, its inner surface engages a foam rubber cleaning pad 156 carried by support 148. We mount a cleaning roll 158 of any suitable material or a brush for rotary movement in tray 26 at a location at which it engages a portion of belt 142 on the roller 138. Pitch chain 146 extends around an idler sprocket wheel 160 to a sprocket wheel 162 which drives roller 158 in a direction opposite to the direction of movement of the belt 142 effectively to clean the outer surface of the belt. A pressure roller 164 ensures firm engagement between belt 142 and the roller 134.

In operation of a system 10 including our self-cleaning developer applicator 24 drum 12 carrying the organic photoconductive film on its surface first passes by the corona 20 which applies an initial charge of, for example, 800 volts to the film 16. As the charged film passes by the exposure station 22, the light image focused thereon causes background areas to be discharged to about 100 volts in the course of an exposure of about 3 footcandle-seconds. Unexposed areas retain a substantial charge. The resultant latent electrostatic image is carried through the developer unit 24. As it moves through this unit, the bias potential applied, for example, between the belt 84 and the conductive substrate of drum 12 in the form of our invention illustrated in FIG. 3 counteracts the effect of the residual potential so that substantially no toner is deposited in these exposed background areas. At the same time, sufficient toner migrates to the unexposed desired image areas to provide adequate contrast for a high quality copy. Under the action of the biasing potential, the toner particles tend to collect on the belt 84. Where only the outer surface of the belt is metallized, brush 106 removes this undesirable buildup of toner particles on the outer surface. If the belt is conductive throughout, toner particles deposited on the inner surface may be removed by use of a backing member 110 of a material which removes particles from that surface.

The operator of our developer applicator in a machine of the linear type such as that illustrated in FIG. 4 is substantially the same as that described above in connection with FIG. 3.

In operation of the developer unit 116 shown in FIG. 5, the counter-rotating gear rollers carry the developer liquid into contact with the surface of film 16 to cause toner particles to be deposited in the desired areas. At the same time, the interengagement of the teeth of the counter-rotating gear rollers provide a cleaning action which removes toner particles which tend to collect thereon under the action of the biasing potential.

In operation of the system illustrated in FIG. 6 the continuously driven steel belt 142 is drawn into an arcuate configuration below the drum 12 by the magnets 152 to form the flow gap 154. Developer liquid is carried by the belt through this space at substantially the velocity of the periphery of drum 12. Owing to that fact, the "tails" which otherwise might form as a result of the drift velocity of toner particles is substantially eliminated. At the same time, the biasing potential applied to the belt overcomes the effect of the residual charge in exposed areas of the film 16. Pad 156 removes toner particles which collect on the inner surface of belt 142 while roller 158 which is driven in a direction opposite to the direction of movement of the belt, cleans accumulated toner particles from the outer surface of the belt.

After emerging from the developer unit 124 in the system illustrated in FIG. 1, the tacky toner image is transferred to the paper from supply 30 under the action of pressure roll 38 and the copy ultimately is delivered to the user by delivery rolls 40 and 42.

While we have shown and described our self-cleaning developer applicator in connection with a system employing a tacky toner, it will be appreciated that the biasing arrangement which we have disclosed has special utility in any system in which an organic photoconductor is being employed. Further, the form of our developer system in which we provide a flow of developer at the same velocity as that of the photoconductor relative to the developer unit has utility in any system in which the "toner-tank tailing" effect is a problem. It will readily be appreciated that a system incorporating an inorganic photoconductor might involve the same problem. It is to be noted further that the belt cleaning arrangements have utility in systems in which these tails are to be eliminated independently of systems incorporating our biasing arrangement.

It will be seen that we have accomplished the objects of our invention. We have provided a self-cleaning developer applicator for a system utilizing an organic photoconductor. Our applicator overcomes the effect of residual charge in exposed areas of an organic photoconductor. Our system ensures that clean copies can be made over a long period of time in use of our applicator. It provides high quality copies in a system employing an organic photoconductor. It does not require an inordinately large optical system nor an excessively long exposure time. The preferred form of our arrangement substantially eliminates the "toner-tank tail" effect present in many systems of the prior art. It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. Apparatus for developing a latent electrostatic image comprising background areas of residual potential and image areas of relatively greater potential on a photoconductive layer carried by a conductive substrate moved past a developing station including in combination a developer unit at said station for applying developer comprising toner and a carrier to said photoconductive layer, said developer unit comprising a tray for holding a supply of said developer and a conductive applicator member for applying said developer to said layer, a source of biasing potential, means for applying said biasing potential to said applicator member to counteract the effect of said residual potential and means for insulating said tray from ground to inhibit deposition of toner thereon under the influence of said biasing potential.

2. Apparatus as in claim 1 including means for cleaning said applicator member.

3. Apparatus as in claim 2 in which said applicator member is a belt and means for driving said belt.

4. Apparatus as in claim 3 in which said cleaning means comprises a cleaning element in said tray in contact with said belt.

5. Apparatus as in claim 2 in which said applicator member is an endless belt mounted for movement in said tank and in which said applying means comprises means for driving said belt.

6. Apparatus as in claim 5 including means for constraining a length of said belt to assume a generally arcuate configuration.

7. Apparatus as in claim 1 in which said developer unit comprises a plurality of gear rollers including said applicator member, means mounting said rollers in said tank with adjacent rollers meshing and means for driving said rollers.

8. Apparatus for developing a latent electrostatic image comprising background areas of residual potential and image areas of relatively greater potential on a photoconductive layer carried by a conductive substrate moved past a developing station including in combination, means at said station for holding a supply of developer made up of toner particles and a carrier, movable means adapted to be driven to carry developer from said supply into contact with the surface of said layer, means for driving said movable means, a source of biasing potential, means for applying said biasing potential between said substrate and said movable means to oppose the effect of said residual charge, means for cleaning said movable means to remove toner particles which collect thereon under the influence of said biasing potential and means for insulating said holding means from ground to inhibit deposition of toner particles thereon under the influence of said biasing potential.

9. Apparatus as in claim 8 in which said movable means is a belt.

10. Apparatus as in claim 9 including means mounting said belt with a length thereof generally parallel to the surface of said layer to form a flow gap between said layer and said belt length, said drive means driving said belt at a speed approximately equal to the surface speed of said layer past said station.

11. Apparatus as in claim 10 in which said belt is formed of conductive magnetic material, said apparatus including magnet means disposed generally along the locus of an arc adjacent to said belt length to cause said belt length to assume a generally arcuate configuration.

12. Apparatus as in claim 11 in which said cleaning means comprises a cleaning roller in engagement with the outer surface of said belt and means for driving said cleaning roller in a direction opposite to the direction of movement of said belt.

13. Apparatus as in claim 12 including a cleaning pad in engagement with the inner surface of said belt.

14. Apparatus for developing a latent electrostatic image on an arcuate surface moved past a developer station including in combination, means at said station for holding a supply of liquid developer, an endless belt of magnetic material, means mounting said belt with a portion thereof immersed in said liquid developer, magnetic means disposed generally along the locus of an arc adjacent to the length of said belt to constrain said length to assume a generally arcuate configuration generally parallel to said surface, and means for driving said belt in the direction of movement of and substantially at the speed of movement of said surface relative to said station to flow said developer into contact with said surface.

* * * * *